United States Patent [19]

Ohseto et al.

[11] Patent Number: 4,727,003

[45] Date of Patent: Feb. 23, 1988

[54] ELECTROLUMINESCENCE DEVICE

[75] Inventors: Seiichi Ohseto, Numazu; Hiroshi Kobayashi; Shosaku Tanaka, both of Totori, all of Japan

[73] Assignee: Ricoh Company, Ltd., Tokyo, Japan

[21] Appl. No.: 911,367

[22] Filed: Sep. 25, 1986

[30] Foreign Application Priority Data

Sep. 30, 1985 [JP] Japan ..... 60-215157

[51] Int. Cl.[4] ..... H05B 33/12

[52] U.S. Cl. ..... 428/690; 428/917; 428/691; 313/503

[58] Field of Search ..... 428/917, 690, 691; 313/503

[56] References Cited

U.S. PATENT DOCUMENTS

| | | | |
|---|---|---|---|
| 3,291,668 | 12/1966 | Goldstein | 428/690 X |
| 3,617,332 | 11/1971 | Lehmann | 428/917 X |
| 4,264,677 | 4/1981 | Koyama et al. | 428/690 X |
| 4,365,184 | 12/1982 | Higton et al. | 313/503 |
| 4,376,145 | 3/1983 | Frame | 428/690 X |
| 4,547,703 | 10/1985 | Fujita et al. | 428/690 X |

FOREIGN PATENT DOCUMENTS

| | | | |
|---|---|---|---|
| 0015115 | 8/1981 | Japan | 428/690 |

*Primary Examiner*—Nancy A. B. Swisher

*Attorney, Agent, or Firm*—Oblon, Fisher, Spivak, McClelland & Maier

[57] ABSTRACT

An electroluminescence device capable of emitting white light is disclosed which comprises a SrS layer with Ce added thereto as an activator and a ZnS layer with Mn added thereto as an activator.

8 Claims, 2 Drawing Figures

ELECTROLUMINESCENCE DEVICE

BACKGROUND OF THE INVENTION

The present invention relates to a thin film electroluminescence device, and more particularly to an emitting electroluminescence device capable of emitting white light. In order to obtain white light emission by use of a conventional electrolumincescence device, the following three methods have been proposed:

(1) Adding a single activator for white light emission to a single host material for attainment of plural electron transitions.

(2) Adding plural activators to a single host material so as to perform additive mixing of different emitted lights to produce white light.

(3) Overlaying a plurality of electroluminescence (hereinafter referred to as EL) emitting layers, each layer comprising a single activator and a single host material, so as to add each EL emission light to produce white light.

The above methods, however, have the following shortcomings. With respect to the first method, praseodymium(Pr) is the only activator available at present praseodymium(Pr) is the only activator available at present for use in the first method and the brightness obtained by this method is insufficient for use in practice.

The second method may be possible, but there has not been discovered yet a combination of a plurality of activators and a single host material that can produce white light by addition of each EL light produced from each activator. Even if such a combination is discovered, it is well predicted that the total brightness obtained will be extremely small due to the interaction of the activators employed, or it will be extremely difficult to harmonize the threshold of the electric field for each EL emission to produce white light emission.

In view of the problems of the above-mentioned first and second methods, the third method appears most promising. In fact, many proposals have been made concerning the overlaying of EL emitting layers according to the third method. However, the conventional third method has the shortcomings that (i) sufficient brightness is not available in the so-called blue EL emission with the emission wavelengths ranging from 400 nm to 500 nm, (ii) the voltage-brightness characteristics are so different between each EL emitting layer that usable white light is not obtained by the addition of the light emitted from each EL shortcomings, a practically usable EL device according to the third method has not been obtained yet.

SUMMARY OF THE INVENTION

It is therefore an object of the present invention to provide a thin film EL device from which the above mentioned conventional shortcomings have been eliminated, capable of emitting white light with high brightness. In order to attain this object of the present invention, the EL device according to the present invention comprises a SrS layer with Ce added thereto as an activator and a ZnS layer with Mn added thereto as an activator.

The present invention is based on the idea that white light can be produced by additive mixing of plural EL lights emitted from plural different overlaid EL emitting layers.

Conventionally, it has been considered that, in order to obtain white light, a blue EL emitting layer, a green EL emitting layer and a red EL emitting layer are necessary. By contrast, according to the present invention, by overlaying two EL emitting layers, that is, the SrS layer with addition thereto of Ce and the ZnS layer with addition thereto of Mn, white light emission with sufficient brightness can be obtained.

DETAILED DESCRIPTION OF PREFERRED EMBODIMENTS

The present invention will now be explained in detail with reference to the following example. The invention is not limited to this example.

EXAMPLE

Figure 1:
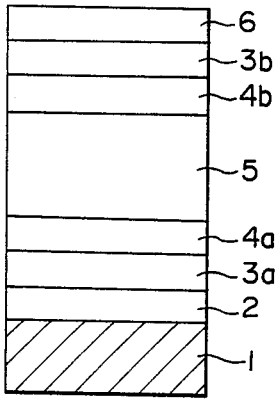
FIG. 1 is a schematic cross-sectional view of an EL device according to the present invention.

A thin film EL device according to the present invention as illustrated in FIG. 1 was fabricated as follows:

On a glass substrate 1 (#7059 made by Corning Glass Works), an ITO transparent electrode layer 2 with a thickness of 500 Å and a first $Y_2O_3$ layer 3*a* with a thickness of 3000 Å were successively formed by the electron beam evaporation method.

On the $Y_2O_3$ insulating layer 3*a*, a ZnS layer with addition thereto of Mn in amount of 1 mol % serving as a first EL emitting layer (hereinafter referred to as the first ZnS:Mn layer 4*a*) was formed with a thickness of 2000 Å at a substrate temperature of 200° C. by the electron beam evaporation method On the first EL emitting layer, a SrS layer with addition thereto of Ce in amount of 0.1 mol % serving as a second EL emitting layer (hereinafter referred to as the SrS:Ce layer 5) was formed with a thickness of 1.2 μm at a substrate temperature of 350° C. by the electron beam evaporation method.

On the second EL emitting layer, a second ZnS:Mn layer 4*b* having the same composition as that of the first ZnS:Mn layer 4*a* was formed by the electron beam evaporation method in the same manner with the same thickness as in the case of the first EL emitting layer.

A second $Y_2O_3$ insulating layer 3*b* was then formed on the second ZnS:Mn layer 4*b* by the electron beam evaporation method in the same manner with the same thickness as in the case of the first insulating layer 3*a*.

Finally, a back electrode layer 6 made of aluminum was formed on the second $Y_2O_3$ insulating layer 3*b*.

In the above EL device, the EL emitting layer SrS:Ce layer 5 was interposed between the two ZnS:Mn layers 4*a* and 4*b*. This was because by the above-mentioned structure, it was avoided for the structurally unstable SrS:Ce layer 5 to come into direct contact with the two $Y_2O_3$ insulating layers 3*a* and 3*b*.

Figure 2:
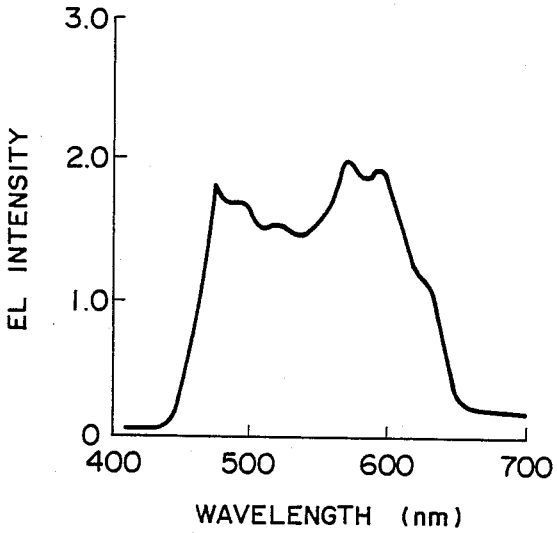
FIG. 2 is an EL spectrum of the EL device shown in FIG. 1.

A 5 kHz sine-wave alternating voltage was applied between the ITO transparent electrode 2 and the back electrode layer 6 of the thus fabricated thin film EL device according to the present invention, with an effective voltage of 240 volt. As a result, a white light emission with a brightness of 1200 cd/m$^2$ having the spectrum as shown in FIG. 2 was obtained.

According to the present invention, white light EL emission with high brightness can be obtained by use of a single drive system with two terminals.

In the present invention, white EL light is obtained by the additive mixing of the bluish green EL emission from the SrS:Ce layer 5 and the orange EL emission from the ZnS:Mn layers 4*a* and 4*b*.

For this purpose, the two layers can be merely superimposed. Alternatively, an electroluminescence multi-layer, for instance, with a three-layer structure in which the SrS:Ce layer is interposed between two ZnS:Mn layers as in the above described example, or the ZnS:Mn layer is interposed between two SrS:Ce layers, or with a multi-layer structure in which plural pairs of the ZnS:Nn layer and the SrS:Ce layer are successively superimposed, can be employed.

In any of the above structures, the brightness ratio of the bluish green EL emission from the SrS:Ce layer to the orange EL emission from the ZnS:Mn layer can be regulated so as to produce white light by adjusting the thickness ratio of the two layers.

In the above example, $Y_2O_3$ was employed as the material for the insulating layer. Instead of $Y_2O_3$, oxides such as $SiO_2$, $Ta_2O_5$ and $Al_2O_3$, nitrides such as $Si_3N_4$ and AlN, and tungusten bronze ferroelectrics and perovskite ferroelectrics can also be employed. These materials can be employed in combination As the material for the transparent electrode layer, ZnO:Al can also be employed instead of ITO.

As the substrate, any materials which are conventionally employed in the field of this art can be employed, for instance, ceramics and heat resistant glass in which alkali components are contained in a relatively small amount.

What is claimed is:

1. An electroluminescence device comprising a substrate, an electrode formed on said substrate, an electroluminescence multi-layer comprising at least (1) a ZnS:Mn luminescence layer comprising ZnS and Mn which serves as an activator and (2) a SrS:Ce luminescence layer comprising SrS and Ce which serves as an activator, which luminescence multi-layer is disposed on said electrode, a back electrode disposed on said luminescence multi-layer, and at least one insulating layer interposed between one of said two electrodes and said luminescence multi-layer.

2. The electroluminescence device as claimed in claim 1, wherein said substrate is made of a material selected from the group consisting of heat resistant glass and ceramics.

3. The electroluminescence device as claimed in claim 1, wherein said electrode is made of a material selected from the group consisting of ITO and ZnO:Al.

4. The electroluminescence device as claimed in claim 1, wherein said luminescence multi-layer further comprises a SrS:Ce luminescence layer comprising SrS and Ce which serves as an activator, which layer is interposed between said ZnS:Mn luminescence layer and said SrS:Ce luminescence layer.

5. The electroluminescence device as claimed in claim 1, wherein said luminescence multi-layer further comprises a ZnS:Mn luminescence layer comprising ZnS and Mn which serves as an activator, which layer is interposed between said ZnS:Mn luminescence layer and said SrS:Ce luminescence layer.

6. The electroluminescence device as claimed in claim 1, wherein said luminescence multi-layer comprises plural pairs of said ZnS:Mn luminescence layer and said SrS:Ce luminescence layer, which are alternatively overlaid.

7. The electroluminescence device as claimed in claim 1, wherein said insulating layer is made of a material selected from the group consisting of $Y_2O_3$, $SiO_2$, $Ta_2O_5$, $Al_2O_3$, $Si_3N_4$, AlN, tungsten bronze ferroelectrics and perovskite ferroelectrics.

8. An electroluminescence device comprising a transparent substrate, a transparent electrode formed on said substrate, a first insulating layer formed on said transparent electrode, a first ZnS:Mn luminescence layer comprising ZnS and Mn which serves as an activator, formed on said insulating layer, a SrS:Ce luminescence layer comprising SrS and Ce which serves as an activator, formed on said ZnS:Mn luminescence layer, and a second ZnS:Mn luminescence layer comprising ZnS and Mn which serves as an activator, formed on said SrS:Ce luminescence layer, a second insulating layer formed on said second ZnS:Mn luminescence layer, and a back electrode layer formed on said second insulating layer.

* * * * *